United States Patent [19]

Cogswell et al.

[11] Patent Number: 4,588,393

[45] Date of Patent: May 13, 1986

[54] APPARATUS AND METHOD FOR FOLDING CUT SHEET PAPER

[75] Inventors: John Cogswell, Needham; Robert F. Fokos, Wayland, both of Mass.

[73] Assignee: Sun Chemical Corporation, New York, N.Y.

[21] Appl. No.: 497,642

[22] Filed: May 24, 1983

[51] Int. Cl.[4] ..... B31B 1/58

[52] U.S. Cl. ..... 493/440; 493/438; 493/441; 493/443; 493/179

[58] Field of Search ..... 493/179, 178, 248, 423, 493/441, 443, 440, 439, 438

[56] References Cited

U.S. PATENT DOCUMENTS

| | | | |
|---|---|---|---|
| 1,096,633 | 5/1914 | La Bombarde | 493/179 |
| 1,868,872 | 7/1932 | Bergstein | 493/179 |
| 2,589,944 | 3/1952 | La Bombarde | 493/179 |
| 2,899,873 | 8/1959 | La Bombard | 493/179 |
| 2,931,277 | 4/1960 | La Bombard | 493/179 |
| 3,073,217 | 1/1963 | Spalding et al. | 493/179 |
| 3,398,660 | 8/1968 | Watrous | 493/178 |
| 3,605,576 | 9/1971 | Shields | 493/441 |

*Primary Examiner*—Daniel C. Crane
*Attorney, Agent, or Firm*—Mitchell D. Bittman

[57] ABSTRACT

Disclosed is an automatic paper folding apparatus and method for folding cut sheet paper products, whether single sheets or multiple piles as in a "signature" that is already folded by a printing press. The apparatus of the invention contains at least one pair of opposed belts which continuously grip the products and carry them through the apparatus. At least one set of freely rotatable rollers is arrayed along the direction of travel. Each belt has a flat paper-gripping surface, a longitudinal groove on the opposite surface that receives a guide roller, and at least one side surface that slopes away from the folding line. Each roller has a conical forming surface. The angle of inclination of the conical surfaces of the rollers in a set increases incrementally along the direction of travel. As the belts carry the sheets through the apparatus, they each engage the conical surface to fold the sheet against a belt with no substantial degree of relative movement between the sheets and either the belts or rollers. A first set of rollers folds the paper from 0° to 90°. A second set of rollers, each of which has an axis of rotation generally perpendicular to that of the rollers in the first set, folds the paper from 90° to 180°. To fold a product into thirds, these first and second roller sets are located on both sides of a central frame member that extends along the travel path of the product.

25 Claims, 21 Drawing Figures

APPARATUS AND METHOD FOR FOLDING CUT SHEET PAPER

BACKGROUND OF THE INVENTION

This invention relates to folding apparatus for paper products and more particularly to apparatus for folding freshly printed cut sheets of paper, whether single sheets or pre-folded "signatures", at very high throughput rates.

Automatic folding machines are used both in binderies to produce printed publications and in industries where it is necessary to fold cardboard. An important use for folding machines is in the production of envelope "inserts" for direct mail marketing. The known paper folding machines that are on press, however, operate at speeds that are relatively slow compared to the line speed of the printing press. The folding process is therefore often a limiting factor on the efficiency of the entire printing line, and therefore, off press finishing of inserts are most common. Typical speeds for such off press folding machines are 5,000–7,000 pieces per hour. Another important use is in the folding of "signatures", that is, printed cut sheets of paper that have already been folded. A typical signature is folded twice to form a four-ply product. In the production of many magazines, the quarter-folded signature is then chop folded in half to produce an eight-ply signature. A significant problem in known systems is that the quarter folding can be done at the speed of the printing machine, but the chop folding and any subsequent folding are done at a significantly slower speed.

Usually in known on-press folding machines, folds are made by mechanical means and twisted belts that engage the paper. In other paper folding machines, and in many cardboard folding machines, the fold is made by driving the paper against a stationary forming member. In either case, a significant problem heretofore has been that these machines are not only relatively slow, but also that there is sliding contacts between the paper and components of the machine that engage the paper. This sliding contact is very undesirable for printed paper products because it tends to mark the printed surface. This is a particularly difficult problem where the printed matter is to be fed directly from a printing press and the ink may not have fully dried. Thus, known folding machines are not suited for integration with the printing apparatus so that the folding can be accomplished as the material is printed and leaves the press.

Besides having a high throughput rate and an avoidance of smearing the printed material, a commercially acceptable folding machine should fold a product either in half or, for letter size inserts, in thirds. If it folds the product twice, ideally it should do so without using two machines or running the same product through the same machine twice. In known folding machines, for example, it is usually necessary to double run a letter size product in order to double fold the insert to a size that will fit a standard No. 10 size envelope (3½ inches by 9 inches). A commercially acceptable folding machine should also operate reliably, maintain a proper alignment of the paper product during the folding, and accept a variety of product sizes and thicknesses, including multiple ply papers that have already been folded at least once.

It is therefore an object of this invention to provide apparatus and a method for folding single sheet and folded cut sheet paper products, and particularly freshly printed products, at very high throughout rates approaching 50,000 to 60,000 products per hour.

It is a further object of this invention to provide apparatus and a method for folding printed paper products without smearing or otherwise defacing the printed matter on the paper.

Another object is to produce a folding apparatus with the foregoing advantages that is also relatively free of paper jams and, if there is a paper jam, allows it to be cleared readily.

A further object of this invention is to provide a folding apparatus and method which can make one or two folds in a paper product with only one pass through the apparatus.

Still another object is to provide a folding apparatus with the foregoing advantages that can fold single or multiple plies of paper.

A further object of this invention is folding apparatus which is of relatively simple mechanical construction.

SUMMARY OF THE INVENTION

The paper folding apparatus and method of the present invention utilize at least one pair of opposed belts which grip a paper product between them with a portion of the paper projecting laterally from the belts. The belts are preferably aligned so that at least one set of their edges are also aligned with one another. The belts are driven to carry the paper product through the apparatus, preferably along a straight horizontal path. Each belt has a flat, paper-gripping surface, a longitudinal groove on the opposite surface that receives a guide roller, and a side surface that slopes away from the paper fold line.

At least one set of freely rotatable rollers are arrayed along the direction of travel of the product. Each of the rollers has a conical forming surface, and the conical surface of each roller has an angle of inclination that increases incrementally from that of adjacent rollers along the direction of travel. These rollers are located with the lower edges of their conical surfaces adjacent the aligned belt edges. As each product is carried by the belts, its projecting portion engages the conical surfaces to fold the paper against the aligned belt edges with no substantial degree of relative movement between the paper product and either the belts or rollers.

For certain folds, a set of rollers is located adjacent one unopposed belt while the paper is gripped by another, parallel set of opposed belts laterally offset from the unopposed belt and associated rollers. With this arrangement, plates of a structural material are located adjacent one of the belts during certain portions of the folding operation to prevent a lift up of the paper during the folding process. In the preferred embodiment, stationary guide rods are located near the projecting folded portion of the paper to control the position of the products after they leave the rollers.

The rollers of at least one set each have an axis of rotation generally perpendicular to the plane along which the incoming paper product travels; they fold the projecting portion of the initially flat product through a 90° rotation. Preferably the first roller has a conical surface inclined at approximately 8°, the final roller has a conical surface inclined at approximately 90°, and the maximum increment in the angle of inclination between adjacent rollers is slightly less than 8°. A second set of rollers each have an axis of rotation generally parallel to the plane along which the incoming product travels for folding the projecting portion of the products through a further 90° rotation. To fold a product into thirds, two additional like sets of rollers are located on opposite sides of a central frame member that extends along the travel path of the products. The central frame provides an alignment reference for all of the operating elements. Each set of rollers is mounted as a unit on this frame. The mounting means, however, allows the set to move between a position adjacent to the belts and a position clear of the belts. Also, each set as well as each roller in a set is adjustable independently of other sets or other rollers in a given set, both vertically and laterally to accommodate different thickness of products and to allow for operating adjustments.

These and other features and objects of the present invention will be more fully understood from the following detailed description which should be read in light of the accompanying drawings.

DETAILED DESCRIPTION OF THE PREFERRED EMBODIMENT

Figure 1:
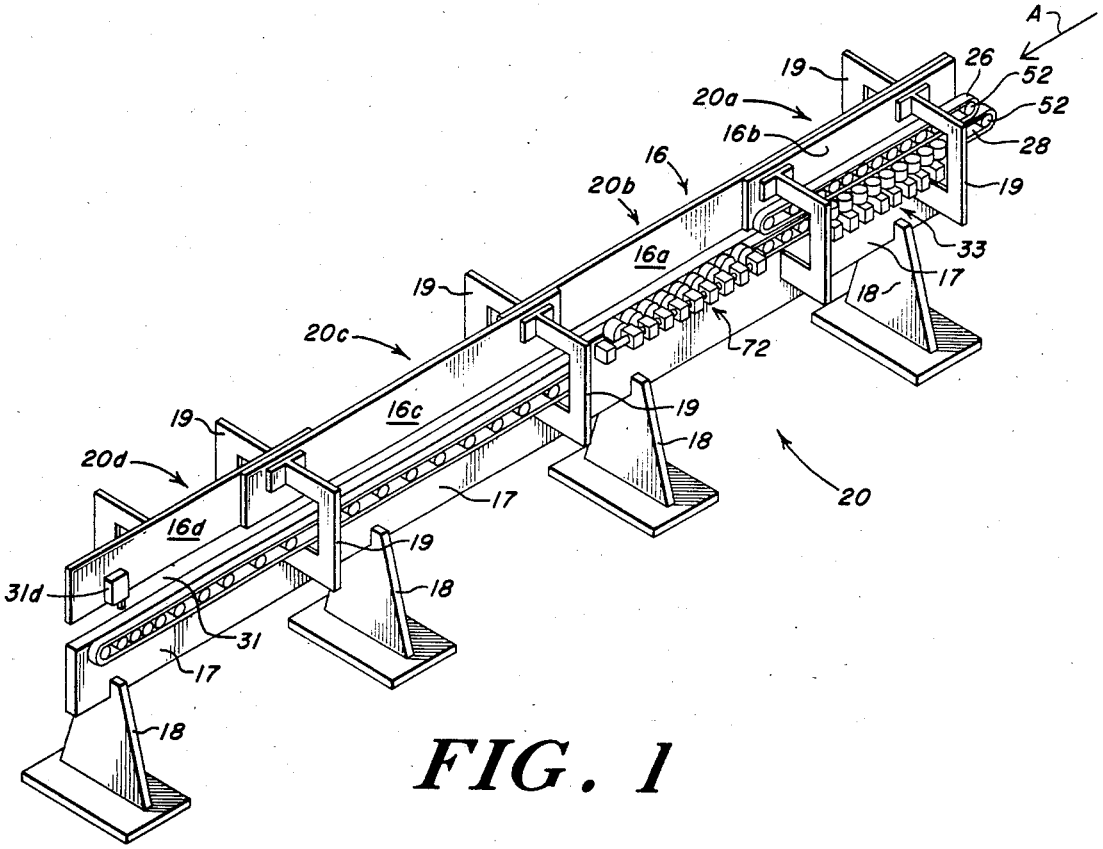
FIG. 1 is a highly simplified perspective schematic view of the folding apparatus disclosed herein.
Figure 2:
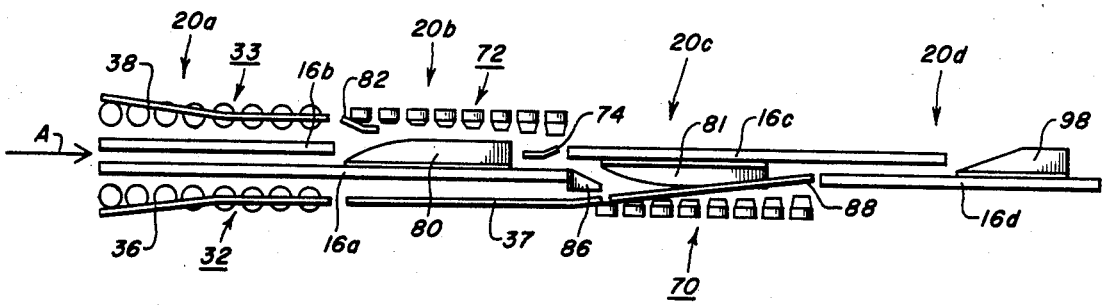
FIG. 2 is a highly simplified top plan view of the folding apparatus of FIG. 1 shown without gripping belts.

Referring to FIGS. 1 and 2, a folding apparatus 20 according to the present invention receives a high speed separated stream of flat paper products at its input end. The paper products are carried by gripping belts through the apparatus in a direction A. While traveling through the apparatus 20 the products are folded and the folded edges are creased.

The apparatus 20 is divided into four sections 20*a*-20*d*, each of which performs a separate function. In section 20*a*, a paper product (usually either a "signature" or an unfolded sheet of paper) is gripped between belts which start the product traveling through the apparatus. An end portion of the product will project from the belts and that projecting portion will be folded from 0°-90°. If the product is to be folded into "thirds" two projecting portions of the product will project from the belts and both portions will be folded from 0°-90°. After the 0°-90° folds are made, section 20*b* will fold one portion of the product from 90°-180° and section 20*c* will fold the other portion from 90°-180°. Finally, section 20*d* will crease the folded edges and carry the product from the apparatus.

The structural support of the apparatus 20 includes an upper central frame 16 and a lower central frame 17 with the upper frame 16 positioned directly above the lower frame 17. Supports 18 mount the frame 17. C-shaped brackets 19 connect the frames 16, 17 to one another to secure them in a rigid, highly straight alignment with an opening 21 between the frames 16 and 17 that defines a straight, horizontal paper product feed path through the apparatus 20.

Figure 3:
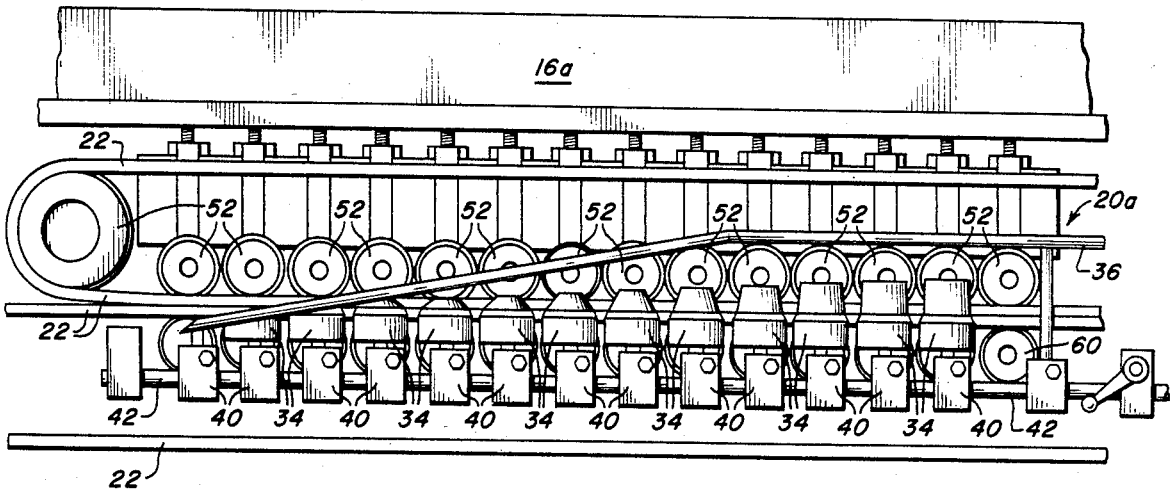
FIG. 3 is a view in side elevation of the portion of the apparatus shown in FIGS. 1 and 2 which makes the initial 0°-90° fold, but with the opposite direction of paper travel from that shown in FIG. 1.
Figure 4:
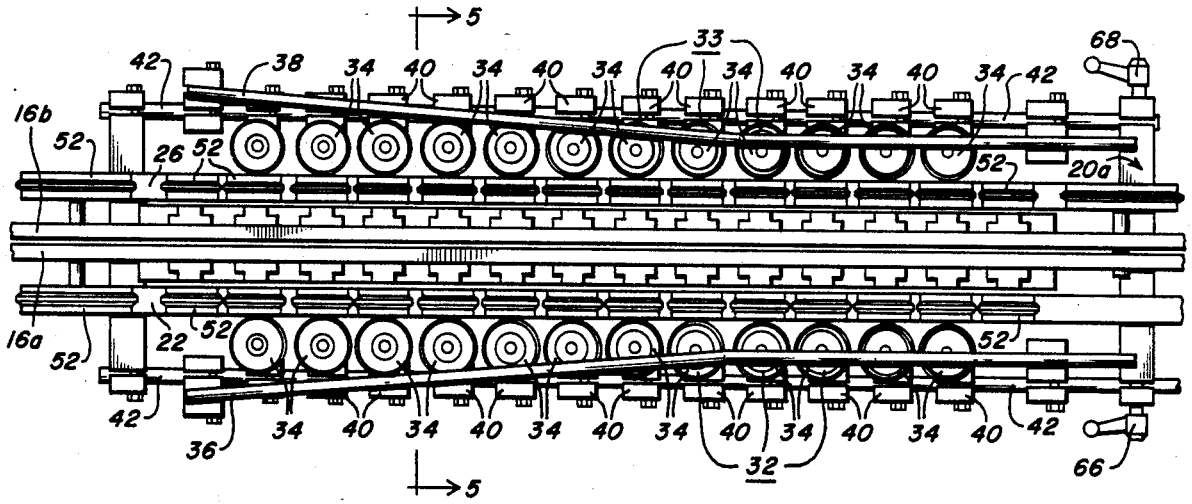
FIG. 4 is a top plan view of the portion of the folding apparatus shown in FIG. 3.
Figure 5:
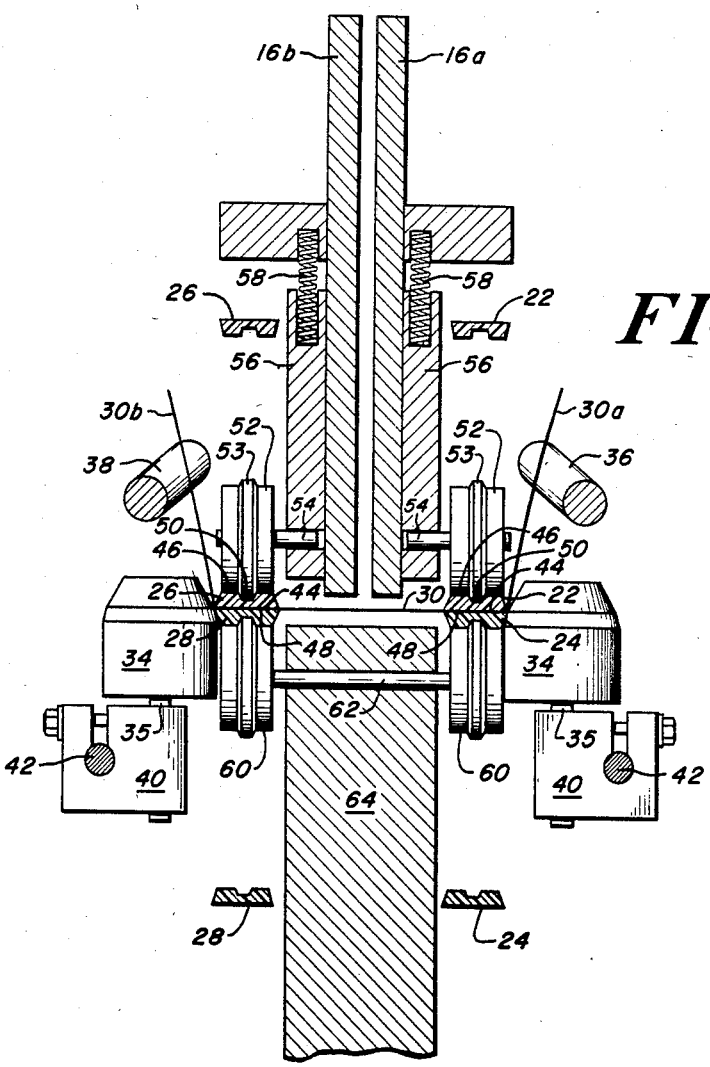
FIG. 5 is a cross-sectional view taken along line 5—5 of FIG. 4.
Figure 8:
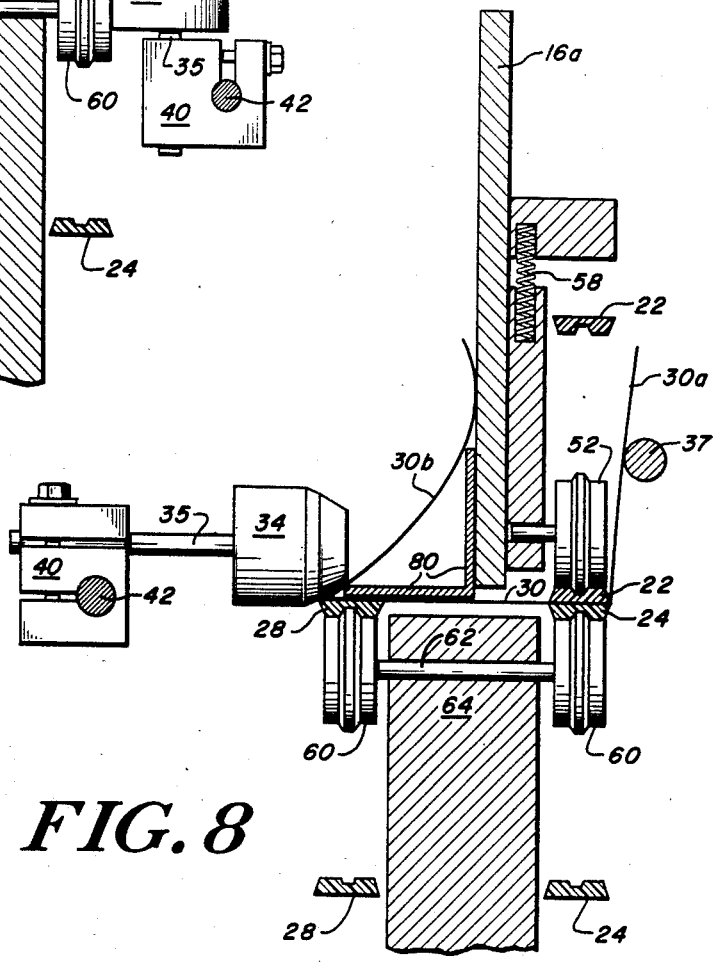
FIG. 8 is a cross-sectional view taken along line 8—8 of FIG. 7.
Figure 6:
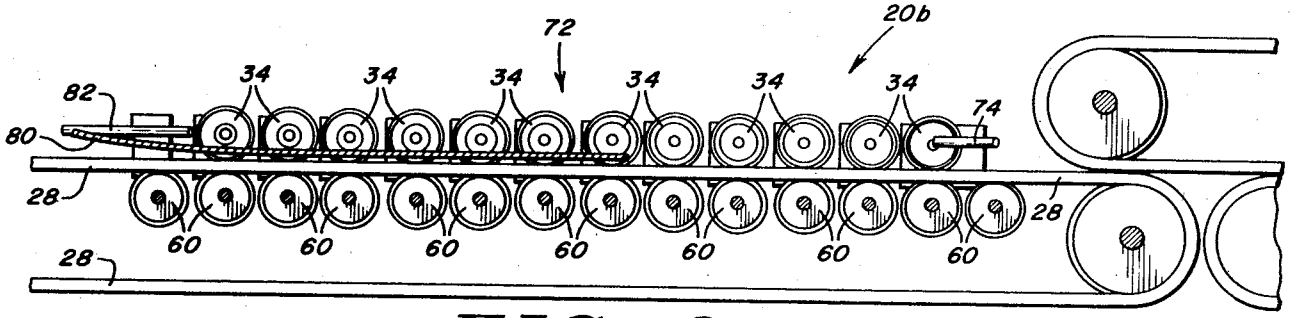
FIG. 6 is a view in side elevation of the portion of the apparatus shown in FIGS. 1 and 2 which folds one portion of a paper product from 90°-180°, but with opposite direction of paper travel from that shown in FIG. 1.
Figure 7:
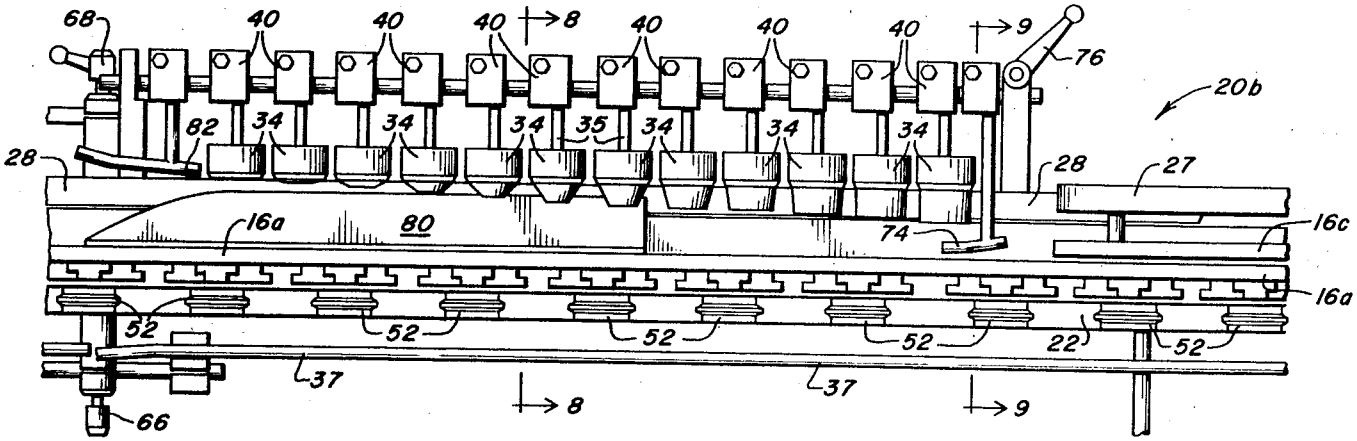
FIG. 7 is a top plan view of the portion of the folding apparatus shown in FIG. 6.
Figure 9:
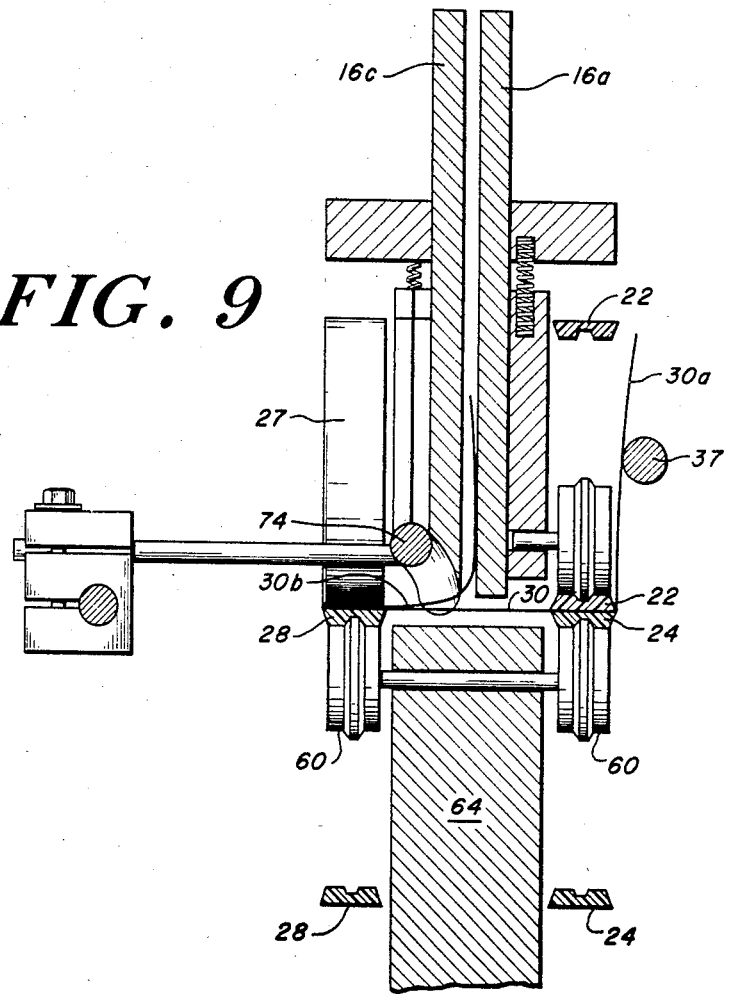
FIG. 9 is a cross-sectional view taken along line 9—9 of FIG. 7.

With reference to FIGS. 3-5, the first section 20*a* of the folding apparatus 20 includes belts 22, 24, 26 and 28 that grip a paper product 30, such as a succession of cut and once of more folded products of paper of conventional letter sizes that have just been printed in a web press. In the preferred embodiment illustrated, the apparatus 20 makes two "cross" folds (across the grain of the paper) in each product 30 to fold it into "thirds" suitable for insertion in a standard No. 10 size envelope. These belts are driven so that the product 30 moves rightwardly, as shown in FIGS. 3 and 4, gripped between the upper belts 22 and 26 and the associated lower belts 24 and 28.

When the apparatus 20 is used in conjunction with a web printing press, the product coming off the press must be broken down into a stream of single pieces since most web presses produce a finished product which leaves the press as part of a shingle stream. It is also important that the products to be folded are fed to the apparatus 20 at a very high speed in a precisely registered and aligned format.

Figure 4B:
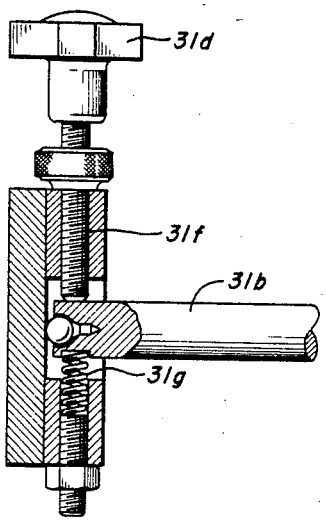
FIG. 4*b* is a view in side elevation of an adjusting screw of the nip-roller assembly of FIG. 4*a;*
Figure 4A:
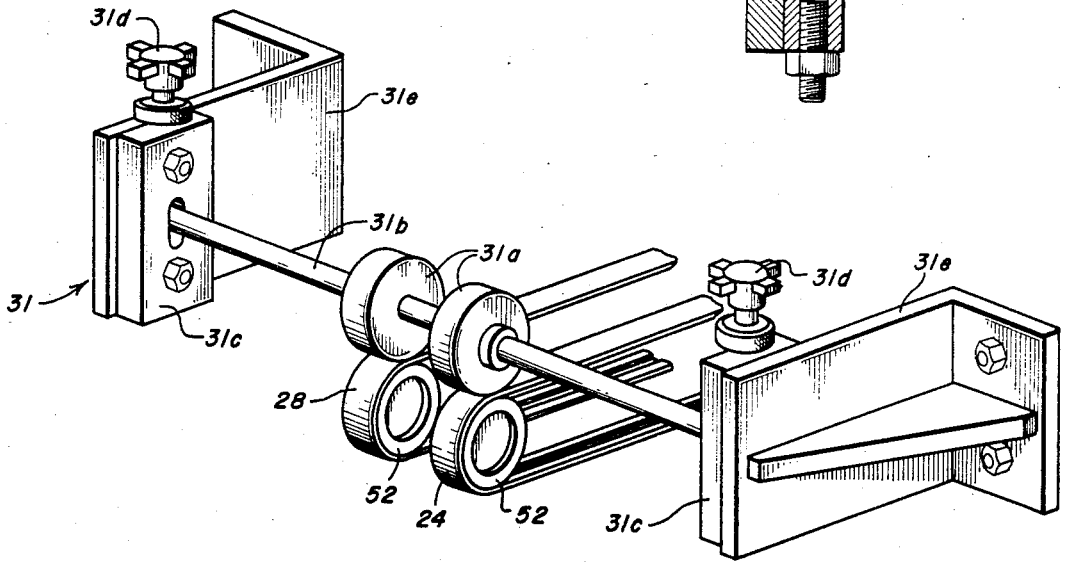
FIG. 4*a* is a perspective view of the nip-roller assembly, shown positioned at the entry end of the folding apparatus of FIG. 1 which is shown without the upper gripping belts.
Figure 4C:
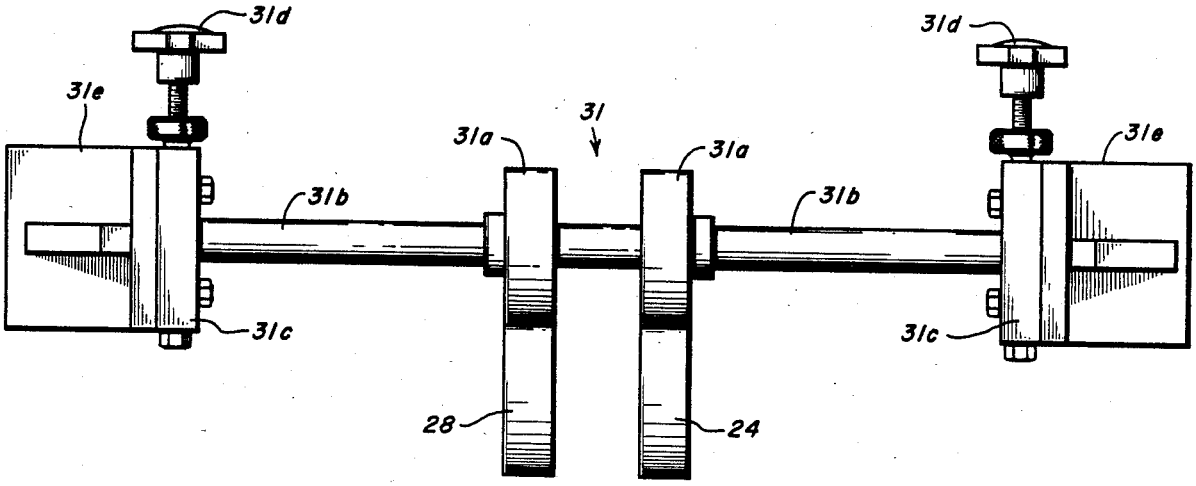
FIG. 4*c* is an elevational view of the nip-roller assembly of FIG. 4*a;*

Even when the products are aligned before they enter the apparatus 20, on occasion the products will be skewed to one side. In order to solve this problem, the apparatus 20, in the preferred embodiment shown in FIGS. 4a–4c (with the upper belts removed for the purpose of clarity), utilizes a nip-roller assembly 31 for controlling skew. The nip-roller assembly 31 includes a pair of nip rollers 31a, 31a which are positioned adjacent to belts 24, 28 at the entry end of the apparatus 20. These nip rollers 31a, 31a are freely rotatable about axle 31b which is supported in axle housings 31c, 31c. The axle housings 31c, 31c are attached to brackets 31e, 31e which are in turn attached to the first set (as viewed from the entry end of the apparatus 20) of C-shaped brackets 19.

The nip rollers 31a, 31a control skew by applying greater pressure to one side of the product 30 than to the other side. The pressure exerted by the nip rollers, and therefore the vertical positioning of the axle 31b, is controlled by adjusting mechanisms located in axle housings 31c,31c. By turning knob 31d in one direction, a screw 31f is depressed in the housing thereby forcing one end of the axle 31b to be lowered with respect to the opposide side of the axle 31b. Springs 31g, 31g are mounted below the ends of each axle 31b. They are positioned to support the axle and act in opposition to the associated knobs 31d.

Disposed adjacent the opposed gripping belts 22 and 24 is a set 32 of rollers 34 and disposed adjacent the gripping belts 26 and 28 is a like set 33 of rollers 34. The rollers 34 of both sets engage the laterally projected portions 30a and 30b of each product 30 causing these portions to be folded upwardly as shown in FIG. 5.

A significant feature of this invention is that the rollers 34 act in cooperation with the aligned adjacent lateral edges of the pair of gripping belts 22, 24 and/or 26, 28 to produce a 90° fold. While making this fold, the apparatus 20, through the opposed belts, maintains a continuous positive grip on the product 30 and allows substantially no relative motion between the product 30 and the folding members. To this end, the rollers 34 are freely rotatable about roller axles 35 so that when the rollers 34 engage the products 30 there is substantially no relative motion between them and the rollers, thus eliminating virtually all of the sliding friction.

The rollers 34 have a generally cylindrical configuration with a conical forming surface located at one end. As illustrated in FIG. 3, the angles of inclination of the surfaces of the rollers 34 within a given set of rollers increase incrementally in the direction of travel of the products 30 through the apparatus. Thus, as the product is transported by the belts, the laterally projecting right 30a and lefthand 30b portions (as shown in FIG. 5) each engage each successive roller. As soon as the product engages one of the rollers 34, the roller 34 begins to rotate such that the surface speed at the conical face matches the speed of the product. As a result, these projecting portions are incrementally folded from an initial flat configuration to a right angle folded position. For handling most products, the first roller 34 in each set should preferably have a conical forming surface with an angle of inclination of approximately 8°. The last roller 34 in each set, as illustrated in FIG. 3, preferably has an angle of inclination of 90°. In order to further facilitate a smooth feed, the heights of the portion of each roller 34 preferably should increase incrementally by no more than 1/16 of an inch for rollers with a diameter of approximately 1⅜ inch.

Each set of rollers is mounted as a unit on the lower frame 17 that extends along the travel path 21 of the products. A housing 40 provides support for each roller axle 35. The corresponding set of housings 40 for each roller set is mounted for rotation on shaft 42, and the shaft 42 is mounted on the lower central frame 17 in such a way so as to allow a roller set to move between a position adjacent to the belts and a position clear of the belts. In addition, each roller set is adjustable independently of other roller sets, and the roller sets can be adjusted both laterally and vertically so as to be able to accommodate products of various sizes and thicknesses. Each roller in a set may also be adjustable independently of other rollers. The primary purpose in providing a means to adjust the rollers is to enable operating adjustments to be made on the apparatus. Adjustment of individual rollers is accomplished either by loosening a bolt on housing 40 thereby freeing roller axle 35 for movement in and out of housing 40, or by rotating housing 40 around shaft 42.

Guide bars 36 and 38 engage the projecting portions 30a and 30b of each product as it is being folded so that once folded they maintain the same general orientation. There may be some slight sliding friction between the product and the guide bars, but it is not of sufficient degree to smear the ink of material printed on the product. While guide bars are shown, their function can also be performed by guide belts running at the travel speed of the product.

With reference to FIG. 3, the gripping belt 22 (and every other gripping belt of the apparatus 20), has a substantially flat face 44 that engages the products 30. A rear face 46 is located opposite the face 44. The opposed belt 24 has a flat, product engaging face 48 located to oppose the face 44 of the belt 22. The two belts 22 and 24 grip a piece of the paper product 30 securely between the faces 44 and 48. The rear face 46 of the belt 22 includes a continuous longitudinal groove 50 adapted to receive spring-loaded idler wheels 52. Each wheel has a circumferential flange 53 which fits snugly in the belt's longitudinal groove 50. The wheels 52 each ride on a shaft 54 which is supported for rotation by a member 56. The member 56 is biased downwardly by a spring 58. This arrangement produces the gripping force of the belts. Similarly, the belt 24 includes a continuous longitudinal groove adapted to engage an idler wheel 60 which is rotatably supported on shaft 62. The shaft 62 is itself supported for rotation in a supporting member 64. The idlers 52 and 60 act in conjunction with the grooves 50 of the associated belts in order to align the belts.

An important element of this invention is the design of the belts in which the side surfaces of the belts 22 and 24 slope away from the flat faces 44 and 48 of the belts 22 and 24. Therefore, when opposite edges of the belts are aligned they form a precisely defined edge against which the products are folded. The importance of the belt design is that a high quality fold is achieved because the design enables the apparatus to form a sharp crease in the product. The groove 50 is also quite important since it, in combination with the idler wheels 60, provides a continuous, reliable and accurate control over the lateral position of the belts. This positional control over the belt in turn guarantees a fold with an accurately predetermined width. This is clearly very important to the operation of the folding apparatus.

This folding apparatus can also be used to fold a product in half. This application is particularly important in the manufacture of most magazines where the web press produces quarter-folded signatures that often are "chop" folded in half, usually at a speed much slower than that of the press. To perform such a fold only the sets of rollers along one side of the apparatus 20 are needed. The unneeded sets of rollers can be pivoted out of the way. Control handles 66 and 68 direct the means used to pivot the roller sets. The turning of control handle 66 will pivot roller set 32 from a position adjacent to the belts 22 and 24 to a position clear of these belts. Guide bars 36 and 37 are also displaced with the roller set when handle 66 is turned. The turning of the control handle 68 will pivot the opposing roller set 33 and corresponding guide bar 38 in the same manner. This pivoting action of the roller sets is also useful to provide access for repairs or to clear paper jams.

Referring to FIGS. 6–9, after the projecting portions of each product 30 are folded through an initial 90°, they are folded through an additional 90° in a second section **20*b* of the apparatus 20 which includes a second pair of roller sets 70 and 72. When a product is to be folded in "thirds", one roller set 72 folds one side 30*b* of the product before the other set 70 folds the opposite side 30*a* of the product. As the product travels away from the roller sets 32 and 33, guidebars 36 and 38** serve to keep the folded-up portions of the product from falling back to a horizontal orientation.

Just before the product approaches roller set 72 it is no longer gripped by two belts on the side of the apparatus where the first 90°–180° fold is to take place. At this point in the folding process, and while the first 90°–180° fold is being made, the product 30 is moved through the apparatus 20 by the gripping belts 22 and 24. A short guidebar 82 directs the folded-up portion **30*b* of the product toward the rollers 34** that will perform the first 90°–180° fold.

A forming plate 80 that is spaced slightly above the product 30 prevents the central portion of the product from lifting up from its plane of travel through the folding apparatus. The forming plate 80 therefore assists the set 72 of rollers 34 to make a clean, even fold in the product. The forming plate 80 should extend along the direction of travel of the paper product a distance approximately equal to the first two-thirds of roller set 72. After this distance, each product will be gripped sufficiently by the belt 28 and the rollers 34 to control the lift up. Also, the folding action at the end of this roller set is directed mainly downwardly, rather than in a direction transverse to the product which can generate a lifting force. While the projecting portion **30*b* is being folded from 90°–180°, the opposing projecting portion 30*a* is prevented from falling back to a horizontal orientation by guide bar 37. It is most important that the rollers 34 of this "second" set 72 rotate freely and have incrementally inclined conical surfaces as with the rollers 34 of the first sets 32 and 33. There should be no relative motion between the rollers 34 and the products or the associated belt 28. The second set 72 preferably includes 12** rollers with an incremental angular increase of the adjacent rollers of approximately 8°.

The upper frame 16 is formed by frame sections **16*a*–16*d* (FIG. 2) positioned directly between the opposing pairs of belts and running along the central longitudinal axis of the apparatus 20** for its entire length. At certain positions of the apparatus there is only one frame section while at other positions there are two parallel frame sections with a small space between the two frame sections. These frame sections guide the ends of the products through the apparatus so that they are not inadvertently creased or bent.

After a first "third" of a product is folded from 90° through 180°, that folded "third" is held in a horizontal folded position by a small guide bar 74. At the position of the apparatus where the product makes contact with the last roller of roller set 72 there is only one frame section **16*a*. The guide bar 74 holds this folded portion down in order to guide it under a second frame section 16*c*. At the same time that portion of the folded "third" which is in an abutting relationship with frame section 16*a* is fed into the gap created by the positioning of a frame section 16*c* parallel to frame section 16*a***.

After one side of the product is folded from 90°–180° that folded edge is gripped by two belts 27 and 28 which coact to crease it. The short guide bar 74 settles and guides the product 30 as it exits from the roller set 72 in order for the gripping belts 27 and 28 to evenly and positively grip the product. These gripping belts 27 and 28 will move the product through the second 90°–180° fold. If the product is not to be folded on the side of the apparatus containing roller set 72 (as may be the case when a product is to be folded in half), the rollers can be pivoted by control handle 76 from a position adjacent to belt 28 to a position clear of the belt.

Figure 12:
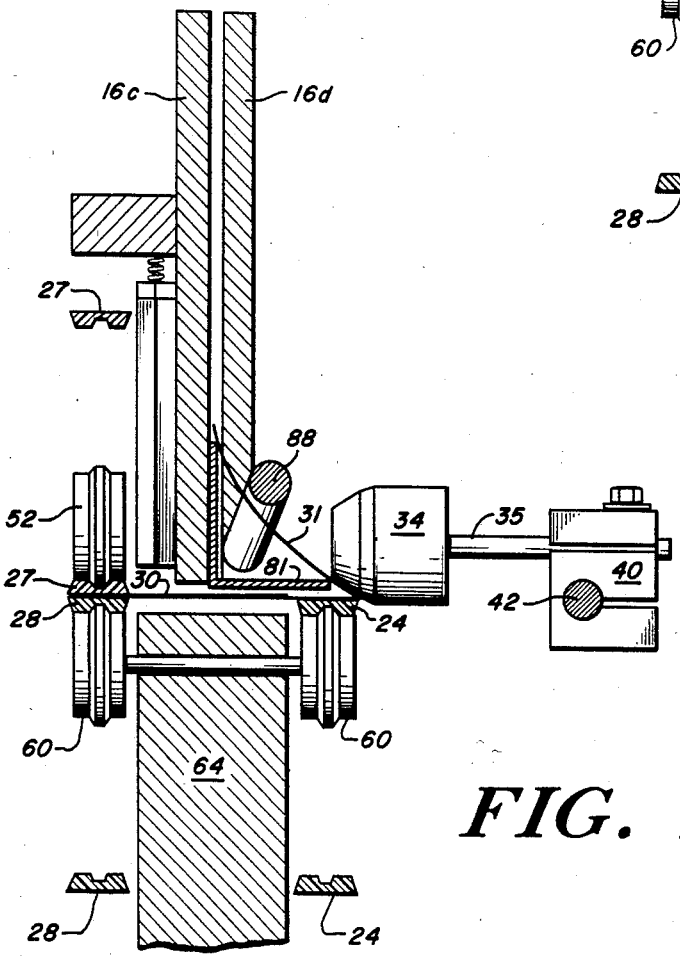
FIG. 12 is a cross-sectional view taken along line 12—12 of FIG. 11.
Figure 10:
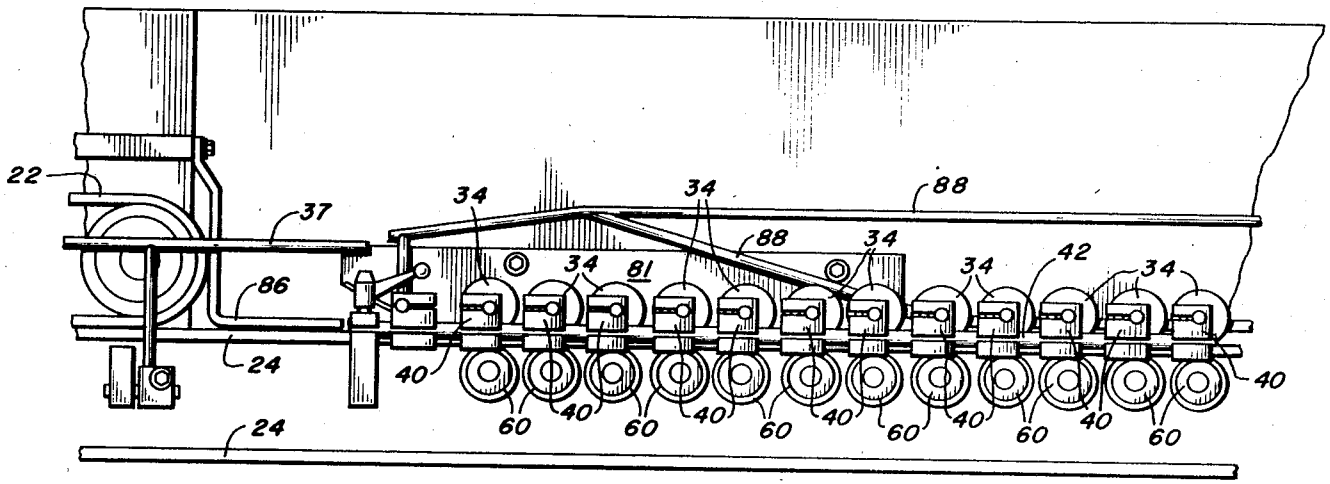
FIG. 10 is a view in side elevation of the portion of the apparatus shown in FIGS. 1 and 2 which folds a second end portion of a paper product from 90°-180°, but with opposite direction of paper travel from that shown in FIG. 1.
Figure 11:
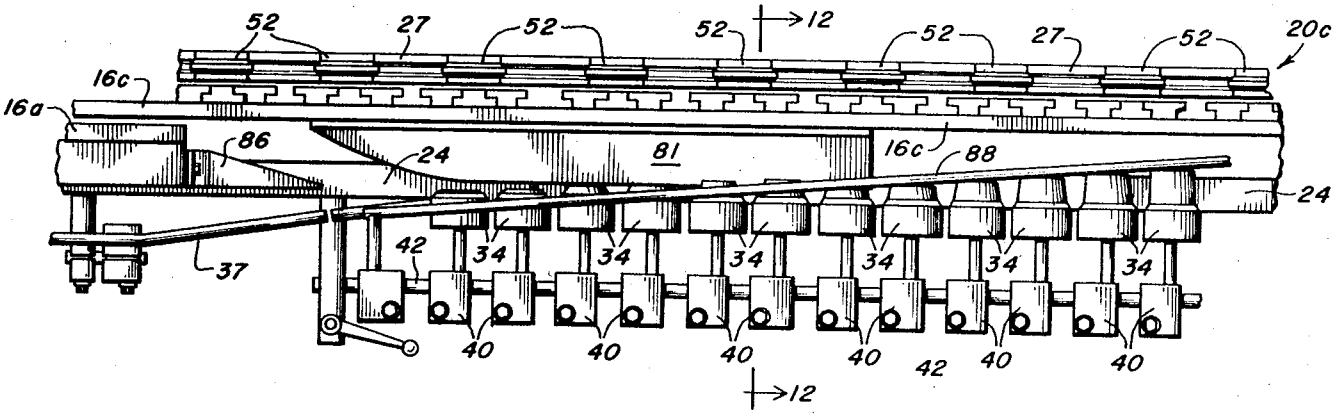
FIG. 11 is a top plan view of the portion of the folding apparatus shown in FIG. 10.

Once the folded edge is gripped by belts 27 and 28, the set 70 of rollers 34 on the opposite side of the apparatus 20 begin to fold the projecting portion **30*a*. Referring to FIGS. 10–12, the "second" set 70 of the second pair of roller sets, which defines a third folding section 20*c* of the apparatus 20, folds the projecting portion 30*a* of the product from 90° through 180°. As the product leaves the gripping belts 22 and 24, which grip the product while the first 90°–180° fold is made, guide plate 86 prevents fluttering of the product. Gripping belts 27 and 28 propel the product through this second 90° to 180° fold. As the product approaches the set 70 of rollers 34 the portion of the product that will constitute the central portion of the final folded product is constrained against an upward movement by a forming plate 81. As with the forming plate 80, the forming plate 81 prevents the product from losing its horizontal orientation thereby enabling the apparatus to produce a clean, even fold. As the central portion of the product is constrained, the rollers 34 fold the projecting portion 30*a*** of the product from 90° through 180°.

At the position of the apparatus where this second 90°–180° fold was made there is only one frame section **16*c*. The portion of the product that was traveling through the apparatus in the gap between frame section 16*a* and 16*c* makes contact with forming plate 81. The forming plate 81 causes the initially folded "third" 30*b* to be folded over in a completely horizontal position so that the product portion 30*a* can be folded on top of the other two "thirds". Therefore, the forming plate 81** not only "holds down" the central portion of the product so that the second 90°–180° fold can be made, but it also aids in completion of the first 90°–180° fold.

The portion **30*a* of the product which is undergoing the second 90°–180° fold may be larger than the distance from the edge of the product being folded by the rollers to the frame section 16*c*. In such a case that "excess" portion will travel in a vertical position between frame section 16*c* and guide bar 88. Guide bar 88 is angled from a position outside the belt edge to a position near the frame section 16*c*. As the guide bar 88 approaches the frame section 16*c*, it is forked to become a double-pronged guide bar with one bar directly above the other. This forked double guide bar configuration enables the apparatus to efficiently fold a variety of product sizes because if only a small "excess" portion of the product has to be maintained in a vertical position then the lower bar will aid in maintaining that position. If the "excess" portion is large then both the upper and lower prongs of the forked guide bar 88 will, along with the frame section 16c**, aid in maintaining the vertical orientation of the "excess" portion.

Figure 13:
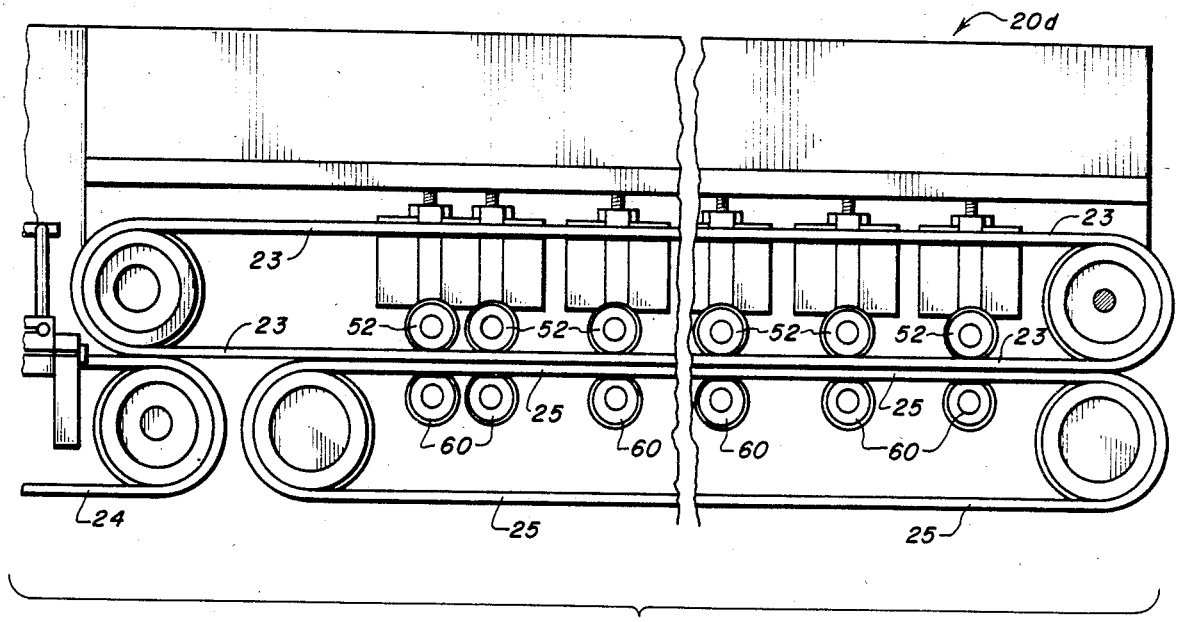
FIG. 13 is a view in side elevation of the portion of the apparatus shown in FIGS. 1 and 2 that creases the folded products, but with opposite direction of paper travel from that shown in FIG. 1.
Figure 14:
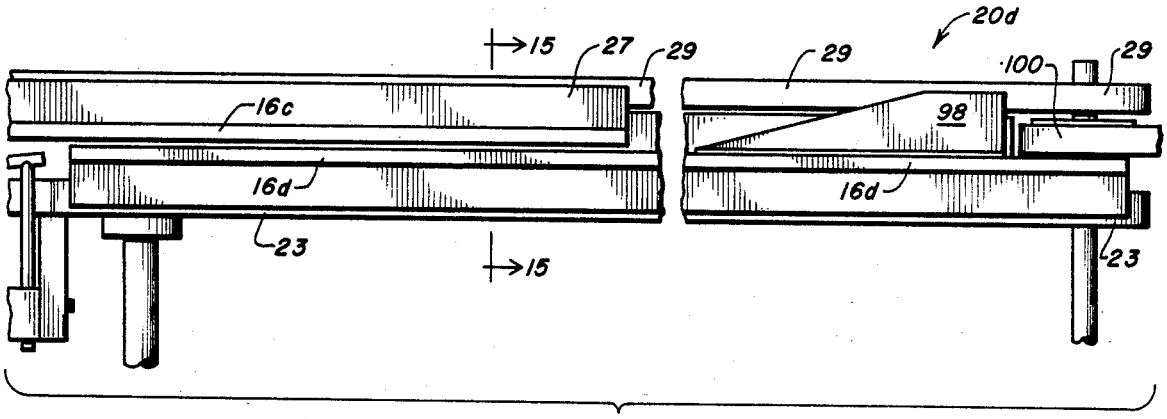
FIG. 14 is a top plan view of the portion of the folding apparatus shown in FIG. 13.
Figure 15:
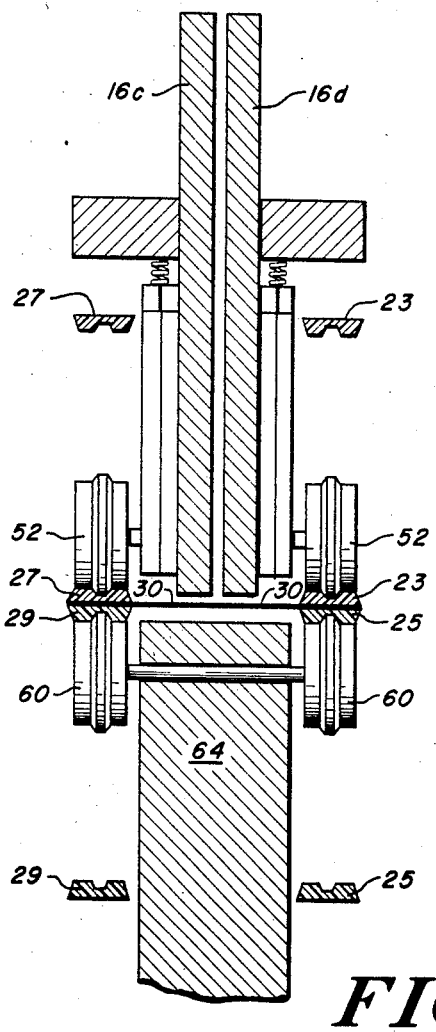
FIG. 15 is a cross-sectional view taken along line 15—15 of FIG. 14.

Referring to FIGS. 13–15, after the second 90°–180° fold has been made gripping belts 23 and 24 grip the edge folded by roller set 70. This begins a further creasing section 20d of the apparatus 20. The product proceeds for a short distance before it is gripped by belts 23 and 25. These belts coact to crease the folded edge. Belts 23 and 25, along with associated belts 27 and 29, also guide the products through the remainder of the apparatus and preferably to a stacker.

At the portion of the apparatus immediately following where the second edge has been folded by roller set 70, the apparatus once again contains two frame sections 16c and 16d. Any excess part of portion 30a that was travelling in a vertical position will pass through a space between frame sections 16c and 16d. A short distance further down the line frame section 16c ends and the "excess" of portion 30a will fall into a flat horizontal position. Forming plate 98 assures that all sides of the final folded product are in a horizontal position. Immediately after passing between the forming plate 98 and belt 29, a third pair of opposed gripping belts 100 and 102 grip the folded product and carry it from the apparatus.

Near the exit end of the apparatus 20, there is positioned a micro-switch 104 (shown in FIG. 1) for detecting paper jams. The micro-switch 31 is a solid state electronic eye which operates by alternately sensing paper and a gap. If the microswitch 31 senses either paper or a gap for longer than one second, a paper jam has been sensed and a mechanism is triggered which shuts down the apparatus 20. To allow time for the first product to pass under micro-switch 31 when the apparatus is initially turned on, a fifteen second power up delay is built into the micro-switch 31. In other words, the micro-switch 31 does not begin to operate until fifteen seconds after the apparatus 20 is turned on. It generally takes about eight seconds for the first product to reach the micro-switch 31 after the apparatus is turned on.

Figure 16:
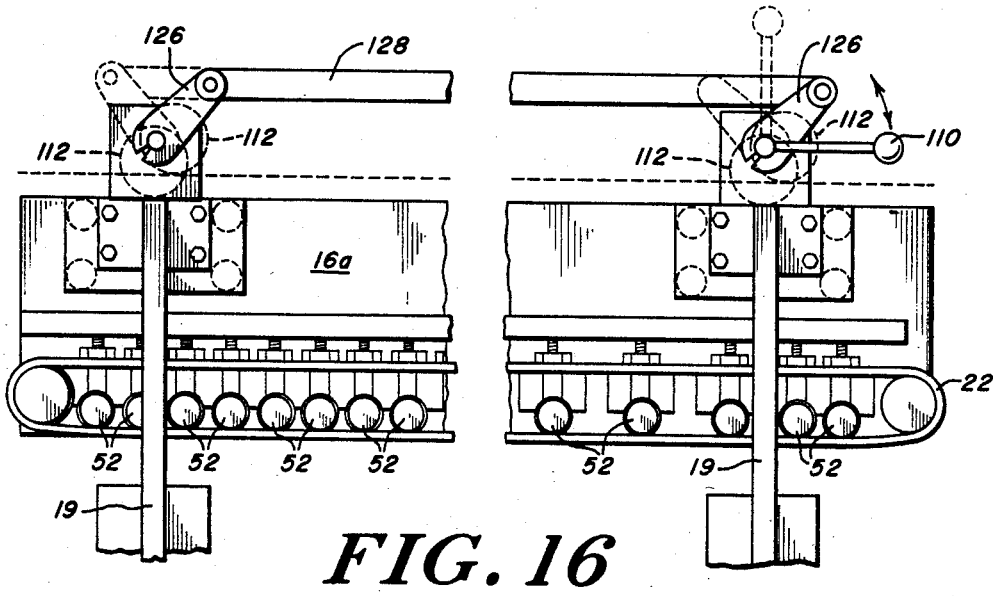
FIG. 16 is a view in side elevation of a portion of the folding apparatus including the mechanism for lifting the upper frame sections.
Figure 17:
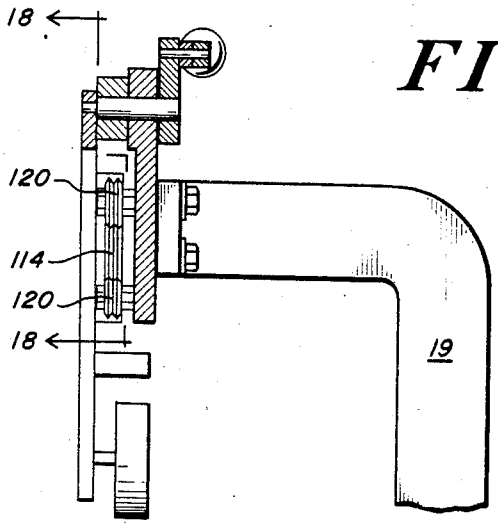
FIG. 17 is a cross-sectional view of the portion of the apparatus shown in FIG. 16.
Figure 18:
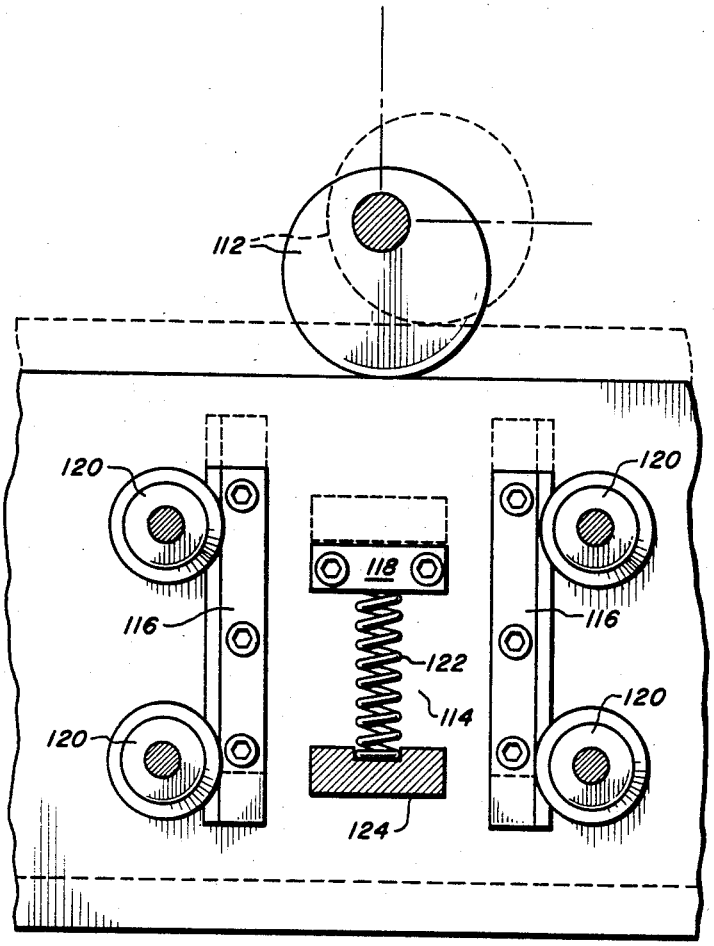
FIG. 18 is a cross-sectional view taken along line 18—18 of FIG. 17.

Once a paper jam is detected, it can be easily cleared. Referring to FIGS. 16–18, there is shown the portion of the folding apparatus 20 which enables lifting of the frame section 16a to increase the opening 21 between frames 16, 17 in order to gain easy access to jammed paper. The other frame section 16b–16d contains similar structures. The handle 110 is raised in order to lift the frame section 16a. The handle 110 is connected to a cam 112 which is connected to frame 16a. In this preferred embodiment, a sliding mechanism 114, which is best seen in FIGS. 17 and 18, contain two tracks, 116, 116 and a center brace 118 which are attached to the frame section 16a. The tracks 116,116 are supported for sliding by four wheels 120 whose axles are supported by the C-shaped bracket 19. Movement of the frame section 16a is restricted by a spring 122 which is supported on one end by center brace 118 and on the other end by brace 124 which is connected to the C-shaped bracket 19.

Since there is only one handle 110, two followers 126,126 are connected to a cam 112 on each end of frame section 16a. When the handle is put in a lift position, the motion of the cam connected to the handle is instilled in the other cam by a rod 128 which is connected on its ends to followers 126,126.

There has been disclosed a folding apparatus capable of a very high throughput rate, with an upper rate in the range of 50–60,000 paper signatures per hour, which can fold even freshly printed paper products without marring their surface. Thus, the folding apparatus disclosed herein can be made an integral part of a printing press operation, particularly a web printer, since the folding apparatus is capable of keeping up with the high line speeds of modern printing apparatus. The apparatus disclosed herein is of comparatively simple mechanical construction and is highly reliable. It is also highly flexible so that different products can be folded either in half or in thirds by simply moving sets of forming rollers from an operative to an inoperative position and making a corresponding adjustment in the alignment of the incoming sheet. The folding apparatus of the present invention avoids the comparatively slow known folding operations for converting cut sheet pages into inserts or for folding signatures into a suitable size for the production of magazines, pamphlets and the like.

The foregoing invention has been described with reference to its preferred embodiments. Variations and modifications doubtlessly will occur to those skilled in the art, and it is intended that all such variations and modifications fall within the scope of the appended claims.

What is claimed is:

1. Apparatus for forming at least one fold in a non-creased sheet-like product, particularly one formed of paper, moving in a first direction, comprising:

at least one pair of opposed belts that positively and continuously grips said product as it traverses said apparatus, with at least one portion of each of said product projecting from one edge of at least one of said gripping belts, said one edge extending in said first direction and providing a reference edge that defines the location of said fold, and said at least one belt having a substantially flat surface that engages said product and a side surface that slopes away from said one edge at an acute angle with respect to a plane perpendicular to said substantially flat belt surface, means for advancing said belts in a manner that carries said gripped product through said apparatus with substantially no relative motion between said belts and said product, means associated with said one edge for rotating said projecting portion of said product through a predetermined angular rotation about and into engagement with said one edge, said rotating means having product engaging means that is inclined with respect to said projecting portion with an angle of inclination that increases incrementally along said first direction, whereby the movement of the product carried by said belts drives said projecting portion of said product onto said engaging means to produce a fold in said product at said one edge, said engaging means being movable with respect to said product advancing through said apparatus so that there is also substantially no relative movement between said engaging means and said product, and a plurality of idler wheels that urge said belts toward one another to grip said product positively as it traverses the folding apparatus along said first direction, said belts each having a continuous longitudinal groove formed in its face opposite said product, said groove having a configuration and dimensions selected to receive said idler wheels in a close-fitting relationship.

2. The folding apparatus according to claim 1 wherein said idler wheels each have a circumferential flange that is received snugly in said longitudinal groove to support and guide said gripping belt.

3. The folding apparatus according to claim 1 wherein said rotating means comprises at least one set of freely rotatable rollers arrayed along said first direction, wherein said rollers have a generally cylindrical configuration with a conical forming surface located at one end, wherein said conical surface has an angle of inclination that increases incrementally from that of adjacent rollers in said set along said first direction, said set of rollers being located with the lower edge of said conical surfaces contiguous with the cylindrical portion of said rollers adjacent the edge of at least one of said gripping belts.

4. The folding apparatus of claim 3 wherein at least one pair of said gripping belts are aligned so that at least one set of their edges are laterally aligned with one another.

5. The folding apparatus according to claim 3 wherein said belts each have a continuous longitudinal groove formed in its face opposite said product, said groove having a configuration and dimensions selected to receive a plurality of spring loaded idler wheels in a close fitting relationship.

6. The folding apparatus according to claim 5 wherein said idler wheels each have a circumferential flange that is receiver snugly in said longitudinal groove to support and guide said gripping belt.

7. The folding apparatus according to claim 6 wherein said belts each have a substantially flat surface that engages said product and a side surface that slopes away from said aligned edge to facilitate said folding.

8. The folding apparatus of claim 3 further comprising means urging said belts toward one another to grip said product positively as it traverses the folding apparatus along said first direction.

9. The folding apparatus according to claim 8 wherein said urging means comprises said plurality of spring loaded idler wheels which are snugly fit in said groove in said belts.

10. The folding apparatus of claim 3 further comprising at least one forming plate disposed adjacent one said set of rollers and spaced slightly from one surface of said product on the opposite side of said product from one of said gripping belts, said forming plate acting in cooperation with said set of forming rollers to fold said product along said first direction.

11. The folding apparatus according to claim 3 further comprising means for retaining said product in a folded position after it leaves said rollers.

12. The folding apparatus according to claim 11 wherein said retaining means includes at least one guide rod closely spaced from said folded product.

13. The folding apparatus of claim 3 wherein one set of said rollers having an axis of rotation generally perpendicular to said product folds a portion of said product through a ninety degree rotation and wherein a second set of said rollers having an axis of rotation generally parallel to said product folds said portion through a further ninety degree rotation.

14. The folding apparatus of claim 13 wherein a further set of said pair of belts crease the fold line produced by said one set and said second set of rollers.

15. The folding apparatus of claim 3 wherein a means is provided to move said set of rollers to a position where said set of rollers will not engage said projecting portion of said product.

16. The folding apparatus of claim 3 further comprising a micro-switch for sensing paper product jams in the folding apparatus, said micro-switch alternately sensing a product and a space, said micro-switch being triggered if either paper or a space is sensed for a time interval greater than one second.

17. The folding apparatus of claim 3 further comprising a cam-controlled sliding assembly for lifting a section of a central frame member.

18. A process for forming at least one fold in a succession of flexible, non-creased, sheet-like products that are moving along a first direction, comprising providing at least one pair of opposed belts at least one of said belts having a substantially flat surface that engages the product, a side surface that slopes away from a reference edge of said flat surface at an acute angle to a plane perpendicular to said substantially flat surface, and a continuous longitudinal groove along the surface opposite said flat surface, gripping said products securely between said belts throughout said process as they move along said first direction with at least one portion of each said products projecting free of said belts, said gripping including providing a plurality of idler wheels received in said longitudinal groove in a close-fitting relationship, providing means for folding said at least one freely projecting portion of each of said products as they advance along said first direction, said folding including a rotation of said projecting portion through a predetermined angular rotation about and into engagement with said reference edge, and said folding increasing incrementally along said first direction, said folding occurring with substantially no relative motion between said products and either said belts or said folding means.

19. The process of claim 18 wherein said folding includes providing a set of freely rotatable rollers having inclined surfaces whose angle of inclination increases incrementally along said first direction.

20. The folding process of claim 19 further comprising the step of positively urging said at least one opposed belts toward one another to grip said products securely.

21. The folding process of claim 20 further comprising the step of creasing said products once they are folded by running them between at least one pair of opposed belts that are thus positively urged towards one another.

22. The folding process of claim 19 further comprising the step of providing a central frame member that extends continuously along said first direction, said central frame member containing at least one central passage extending along at least a portion of said central frame member, said central passages extending along said first direction to allow the movement of said products therethrough, and the further step of aligning said folding about said frame.

23. The folding process of claim 22 further comprising the step of selectively providing a further said abutment surface and further said sets of freely rotatable rollers to produce further folding of said products.

24. The folding process of claim 23 wherein said providing of further abutment surfaces comprises providing said inclined surfaces adjacent to the edge of at least one unopposed gripping belt.

25. The folding process of claim 23 wherein said providing of further said abutment surfaces comprises providing a forming plate with a longitudinal edge aligned with said first direction along the intended fold line but spaced slightly from said inclined surfaces to avoid a running contact with said products.

* * * * *